US007874423B2

(12) United States Patent
Chang

(10) Patent No.: US 7,874,423 B2
(45) Date of Patent: Jan. 25, 2011

(54) DEVICE AND METHOD FOR DISPLAYING NECKTIES

(75) Inventor: William Chang, New York, NY (US)

(73) Assignee: AW Chang Corporation, Los Angeles, CA (US)

( * ) Notice: Subject to any disclaimer, the term of this patent is extended or adjusted under 35 U.S.C. 154(b) by 300 days.

(21) Appl. No.: 11/895,258

(22) Filed: Aug. 22, 2007

(65) Prior Publication Data

US 2009/0050497 A1 Feb. 26, 2009

(51) Int. Cl.

| | |
|---|---|
| ***B65D 85/18*** | (2006.01) |
| ***A41D 27/22*** | (2006.01) |
| ***A47F 3/00*** | (2006.01) |
| ***A47F 7/00*** | (2006.01) |

(52) U.S. Cl. ..... 206/292; 186/35; 211/85.3; 223/85

(58) Field of Classification Search ..... 206/287, 206/292, 278, 281, 285, 298; 40/669; 223/83–85, 223/DIG. 1; 211/85.3; 186/35; 229/87.15
See application file for complete search history.

(56) References Cited

U.S. PATENT DOCUMENTS

| | | | | |
|---|---|---|---|---|
| 2,191,714 | A * | 2/1940 | Gustin | 211/119 |
| 2,284,979 | A * | 6/1942 | Lazarus | 211/113 |
| 2,488,973 | A * | 11/1949 | Hall | 223/87 |
| 2,505,836 | A * | 5/1950 | Robbins | 24/703.3 |
| 2,994,462 | A * | 8/1961 | Hirsch et al. | 223/85 |
| 3,069,009 | A * | 12/1962 | Hoeflich | 206/284 |
| 3,611,597 | A * | 10/1971 | Boyd | 40/669 |
| 5,328,065 | A * | 7/1994 | Kolton et al. | 223/85 |
| 5,429,284 | A * | 7/1995 | Kolton et al. | 223/85 |
| 5,626,268 | A * | 5/1997 | Kolton et al. | 223/85 |
| 6,202,905 | B1 * | 3/2001 | Heide | 223/94 |
| 2001/0015363 | A1 * | 8/2001 | Rahmey | 223/96 |
| 2007/0045136 | A1 * | 3/2007 | Kim | 206/278 |

* cited by examiner

*Primary Examiner*—Sue A Weaver
(74) *Attorney, Agent, or Firm*—D. Morgan Tench

(57) ABSTRACT

The invention provides a device and a method for packaging of one or more neckties for retail display. The device includes a hanger part for hanging neckties on a rack, and a fastener part for holding the neckties together so as to maintain an orderly appearance. The device is inexpensive, convenient to use, and offers enhanced opportunity for brand identification and advertisement.

17 Claims, 8 Drawing Sheets

DEVICE AND METHOD FOR DISPLAYING NECKTIES

BACKGROUND OF THE INVENTION

1. Field of the Invention

This invention is concerned with merchandising, and in particular with packaging and retail display of neckties.

2. Description of the Related Art

A modern necktie has a front side comprising seamless cloth with a pleasing pattern and a backside with a lengthwise seam, and includes a wide section and a narrow section. FIG. 1 depicts two views of a typical modern necktie 100 of the prior art showing: (A) the front side 101 of the wide section and the backside 102 of the narrow section of the necktie with seam 103; and (B) the front side 104 of the narrow section and the backside 105 of the wide section of the necktie with seam 106. A cloth strip 107 is usually attached to backside 105 of the wide section of necktie 100 via stitching at each end of the cloth strip so as to form a first "loop" through which the narrow end of the necktie may be inserted to keep it out of sight and out of the way. A second strip of cloth 108 displaying a logo or brand name may also be attached to backside 105 via stitching at each end so as to form a second loop that may also serve the same function as the first loop. Only one such loop is needed to practice the present invention and no distinction with respect to the type of loop is made. The terminology presented in this paragraph is used throughout this document.

Packaging and retail displays for neckties need to be attractive and readily maintained in an orderly condition. Consumers often disassemble necktie packaging and leave unpackaged neckties lying about, which degrades the appearance of the display and may result in lost or confusing pricing information. Available tamper-resistant packaging offers limited opportunities for creating attractive packaging and for brand advertisement. There is a need for economical necktie packaging that is attractive, discourages disassembly, and offers enhanced opportunity for brand advertisement.

SUMMARY OF THE INVENTION

The invention provides a device and a method for packaging a necktie having a narrow section and a wide section and including at least one loop on the backside of the wide section of the necktie, and for packaging a plurality of such neckties together in one package. The device comprises a hanger part for hanging the device, and the necktie or neckties installed therein, on a rack, and a fastener part for holding the wide and narrow sections of the necktie or neckties together. The hanger part comprises a hook attached to a frame that supports one or a plurality of internal bars over at least one of which a necktie is installed.

The fastener part is fabricated from a sheet of a cardboard or a plastic material, for example, and comprises: an open-ended enclosure having a quadrangular cross-section whose four sides form a conduit opening; and a rectangular tab strip which is an extension of a tab side of said open-ended enclosure and includes a rectangular tab strip fold line at a predetermined location. In one embodiment, the fastener part further comprises a linear slit in the tab side, which is substantially perpendicular to the long sides of the rectangular tab strip and is sufficiently wide to accommodate insertion of the unattached end of the rectangular tab strip. In another embodiment, the unattached end of the rectangular tab strip is semi-permanently attached to the tab side, via an adhesive or one or more staples, for example, so that the linear slit is not necessary. However, another means of attachment may be used in addition to the linear slit to provide a more secure and/or better aligned attachment. The fastener part is fabricated by an appropriate combination of operations selected from the group consisting of cutting, creasing, stamping, folding and joining.

In the method of the invention, each necktie to be installed on the hanger part and packaged together is folded to produce a necktie middle fold, for which the front side of the necktie faces outward, the narrow section of the necktie passes through at least one loop on the backside of the wide section of the necktie, and the end of the narrow section of the necktie is located substantially short of the end of the wide section of the necktie. Each necktie is installed on the hanger part such that the necktie middle fold and the two ends of each necktie are on the same side of the hanger part and the necktie middle fold and the end of the narrow section are located substantially short of the end of the wide section of the necktie. The necktie middle fold and the ends of the wide and narrow sections of each necktie installed on the hanger part are inserted through the conduit opening until the fastener part is located close to the hanger part. The unattached end of the rectangular tab strip is then inserted through at least one loop on the backside of the wide section of the packaged necktie contiguous with the rectangular tab strip, the rectangular tab strip is folded at the rectangular tab strip fold line, and the unattached end of the rectangular tab strip is attached to one or both of a bottom area of the tab side or a top area of the rectangular tab strip. The unattached end of the rectangular tab strip may be attached via an adhesive or one or more staples, for example, or may be inserted into a slit in the tab side, or both.

The device of the invention is inexpensive, convenient to use, and offers enhanced opportunity for brand identification and advertisement. The fastener part of the invention holds the packaged neckties together in an attractive package that can be imprinted with a brand name or other advertisement. Since the procedure for disassembly of the package of the invention is not readily apparent, customers are discouraged from opening the package so that a necktie display employing the device and method of the invention tends to remain orderly and attractive. In one embodiment, the package is held together via an adhesive, one or more staples or another type of semi-permanent attachment so that undesirable disassembly is further discouraged.

Further features and advantages of the invention will be apparent to those skilled in the art from the following detailed description, taken together with the accompanying drawings.

These figures are not to scale and some features have been enlarged for better depiction of the features and operation of the invention.

DETAILED DESCRIPTION OF THE INVENTION

The invention provides a device and a method for packaging a necktie or a plurality of neckties, each having a narrow section and a wide section and at least one of which includes at least one loop on the backside of the wide section. The device comprises a hanger part for hanging the device and the necktie or neckties packaged therein on a rack, and a fastener part for holding the packaged necktie or neckties together and providing brand identification and advertising.

Figure 2:
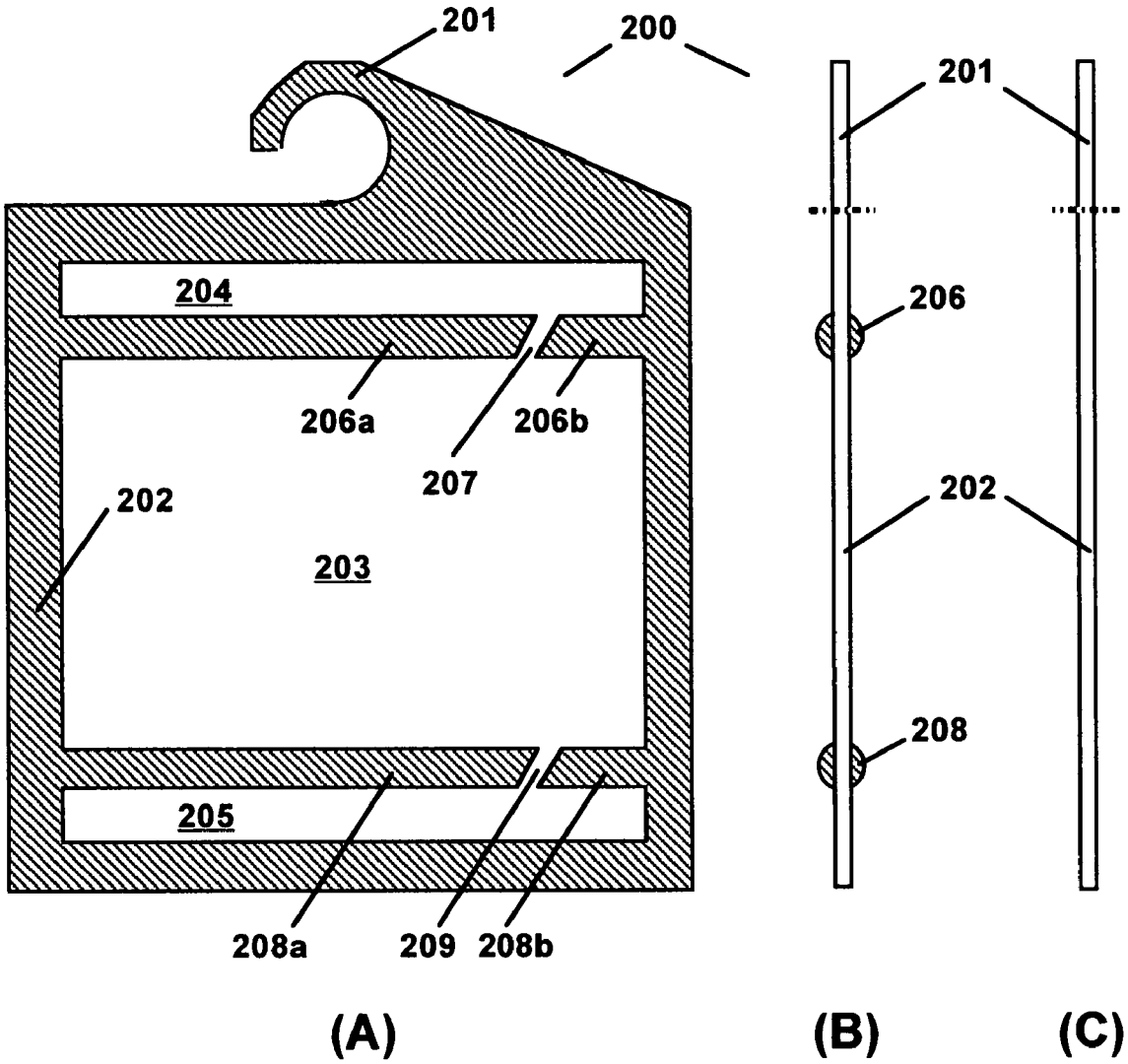
FIG. 2 depicts a front view (A) of a hanger part of a device according to the invention, as well as two side views (B and C) illustrating two embodiments of the device.

FIG. 2 depicts a front view (A) of a hanger part of a device according to the invention, as well as two side views (B and C) illustrating two embodiments of the device. Hanger part 200 comprises a hook 201 attached to a frame 202 that supports one or a plurality of internal bars over at least one of which a necktie is installed. FIG. 2A depicts two such internal bars 206 and 208 which, in conjunction with frame 202 delineate a larger open area 203 and two smaller open areas 204 and 205. Internal bars 206 and 208 also include optional discontinuities 207 and 209 that, respectively, divide internal bar 206 into sections 206*a* and 206*b* and internal bar 208 into sections 208*a* and 208*b*, so that a portion of the bar may be temporarily deformed (pushed to the side) to facilitate installation of a necktie. Discontinuities 207 and 209 are preferably slanted, at a 45° angle, for example, relative to the axes of internal bars 206 and 208. One or more of the internal bars may be tapered (not shown) in the vicinity of the discontinuity to further facilitate installation of a necktie.

The hanger part may be of any suitable shape, size and thickness, including variable thickness. One or more internal bars, for example, may have a transverse cross-section with a thickness greater than the thickness of the frame. FIG. 2B depicts a side view of hanger part 200 wherein internal bars 206 and 208 have a transverse cross-section that is circular with a diameter greater than the thickness of frame 202 (and hook 201). The transverse cross-section of the internal bars may also include a semicircle, for example, and may be different in shape or size for different internal bars within the same frame. One or more of the internal bars may also be tapered, overall or locally. Hook 201 of hanger part 200 may also be thicker, overall or in some areas, than frame 202 to add strength or improve appearance. As illustrated in FIG. 2C, the hanger part may also be of uniform thickness. The frame of the hanger part may have any suitable geometric shape, including rectangular, as depicted in FIG. 2A, circular or elliptical. Some or all of the corners and sharp edges of the hanger part may be rounded. Grooves or other recesses may be incorporated in the hanger part to conserve material or for structural reasons.

The hanger part may be monolithic or comprise separate parts attached via an adhesive or other suitable means, and may be fabricated by any suitable method from any suitable material or materials. Preferably, the hanger part is monolithic, comprises a plastic material, and is fabricated by injection molding.

Figure 3:
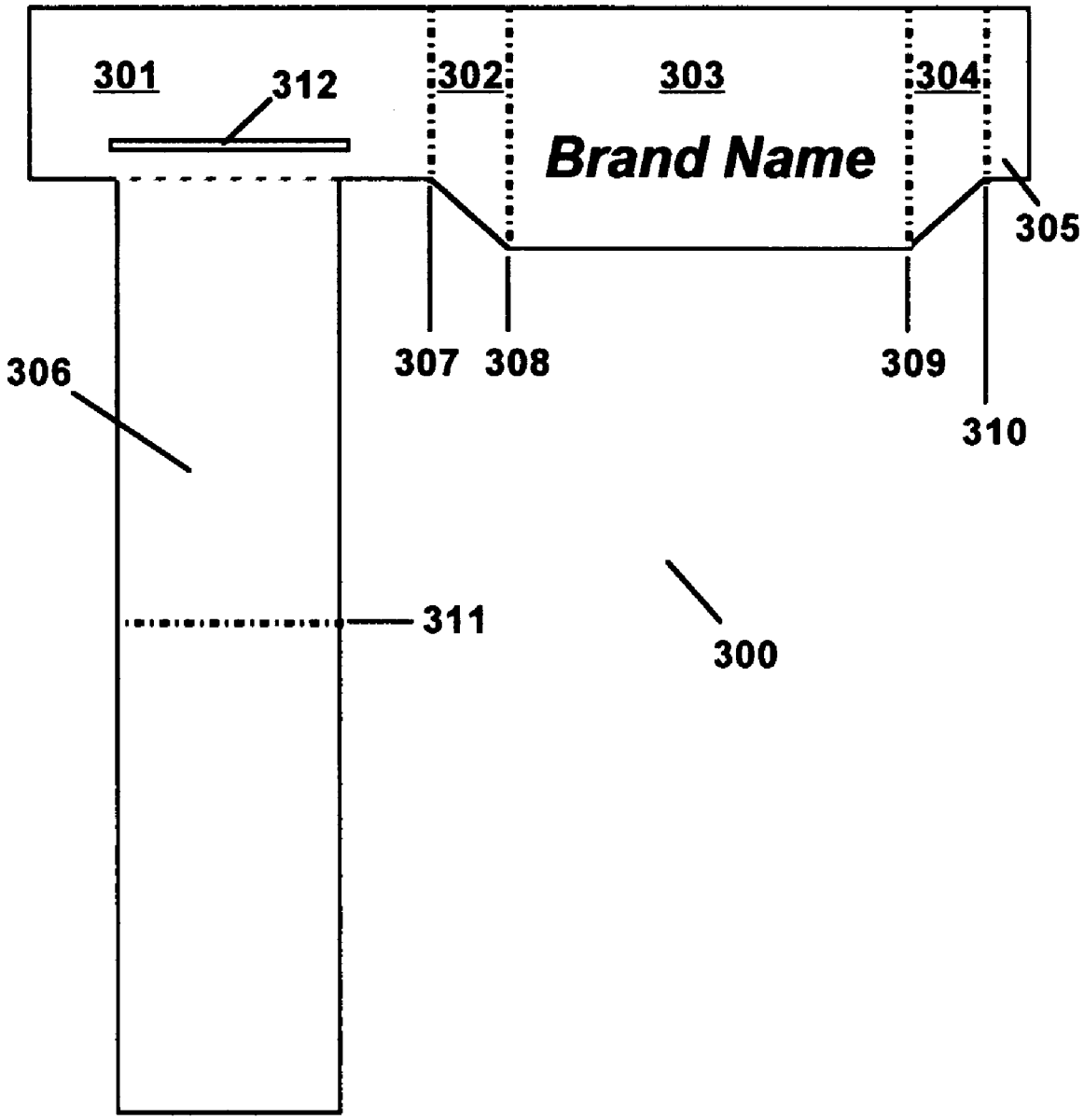
FIG. 3 depicts a preform for fabrication of the fastener part of a device according to the invention.

FIG. 3 depicts a preform 300 for fabrication of the fastener part of a device according to the invention. Preform 300 is fabricated from a sheet of a material, which may include a surface finish, printing at predetermined locations, or both. For example, a brand name or other advertisement may be printed (as indicated) on panel 303, which becomes the front side of the finished fastener part of the device. Preform 300 is divided into four sides (301, 302, 303 and 304) and a joiner tab 305 delineated by fold lines 307, 308, 309 and 310. Preform 300 also includes a rectangular tab strip 306, which is an extension of a tab side 301 and includes a rectangular tab strip fold line 311 at a predetermined location. A brand name or other advertisement (not shown) may be printed upside down on the lower backside of rectangular tab strip 306, which will appear upright on the backside of the fully assembled fastener part. Optionally, tab side 301 may also include a linear slit 312, which is substantially perpendicular to the long sides of rectangular tab strip 306 and is located substantially above the top of rectangular tab strip 306. Linear slit 312 is sufficiently wide to accommodate insertion of the unattached end of rectangular tab strip 306. The predetermined location of rectangular tab strip fold line 311 is sufficiently closer to linear slit 312 than to the unattached end of rectangular tab strip 306 that the unattached end of rectangular tab strip 306, when rectangular tab strip 306 is folded along rectangular tab strip fold line 311 at an approximately 180° angle, can be inserted in linear slit 312 and be securely held in place.

Alternatively, the end of folded rectangular tab strip 306 may be semi-permanently attached to a bottom area of tab side 301, or to the top area of rectangular tab strip 306, or both so that linear slit 312 is not necessary. In a preferred embodiment, the predetermined location of rectangular tab strip fold line 311 is sufficiently closer to the bottom edge of tab side 301 than to the unattached end of rectangular tab strip 306 that the unattached end of rectangular tab strip 306, when rectangular tab strip 306 is folded along rectangular tab strip fold line 311 at an approximately 180° angle, overlaps a bottom area of tab side 301 to form an overlap region of sufficient area that the unattached end of rectangular tab strip 306 may be semi-permanently attached to the bottom portion of tab side 301 via an adhesive (including one-sided or two-sided tape), one or more staples, or any other suitable means. The unattached end of rectangular tab strip 306 may also be attached, exclusively or partly, to the top portion of rectangular tab strip 306. For these alternative cases, linear slit 312 may be omitted or simply not be used, or may be used with the semi-permanent attachment.

A fastener part may be fabricated from preform 300 by making an approximately right angle fold at each of the fold lines 307, 308, 309 and 310, and joining joiner tab 305 to the edge of side 301 using an adhesive or any other suitable attachment means, one or more staples, for example. The attachment means, the adhesive or the one or more staples, for example, subsists within the rectangular box defined by joiner tab 305. The fold lines are preferably creased to facilitate folding.

Preforms for the fastener part of the invention are preferably fabricated from a sheet of a cardboard or plastic material by a stamping operation, which simultaneously cuts the outline of the preform and the linear slit in the tab side (if needed), and provides creases along the fold lines to facilitate folding. Fastener part preforms may also be fabricated by separate cutting and creasing operations.

Figure 4:
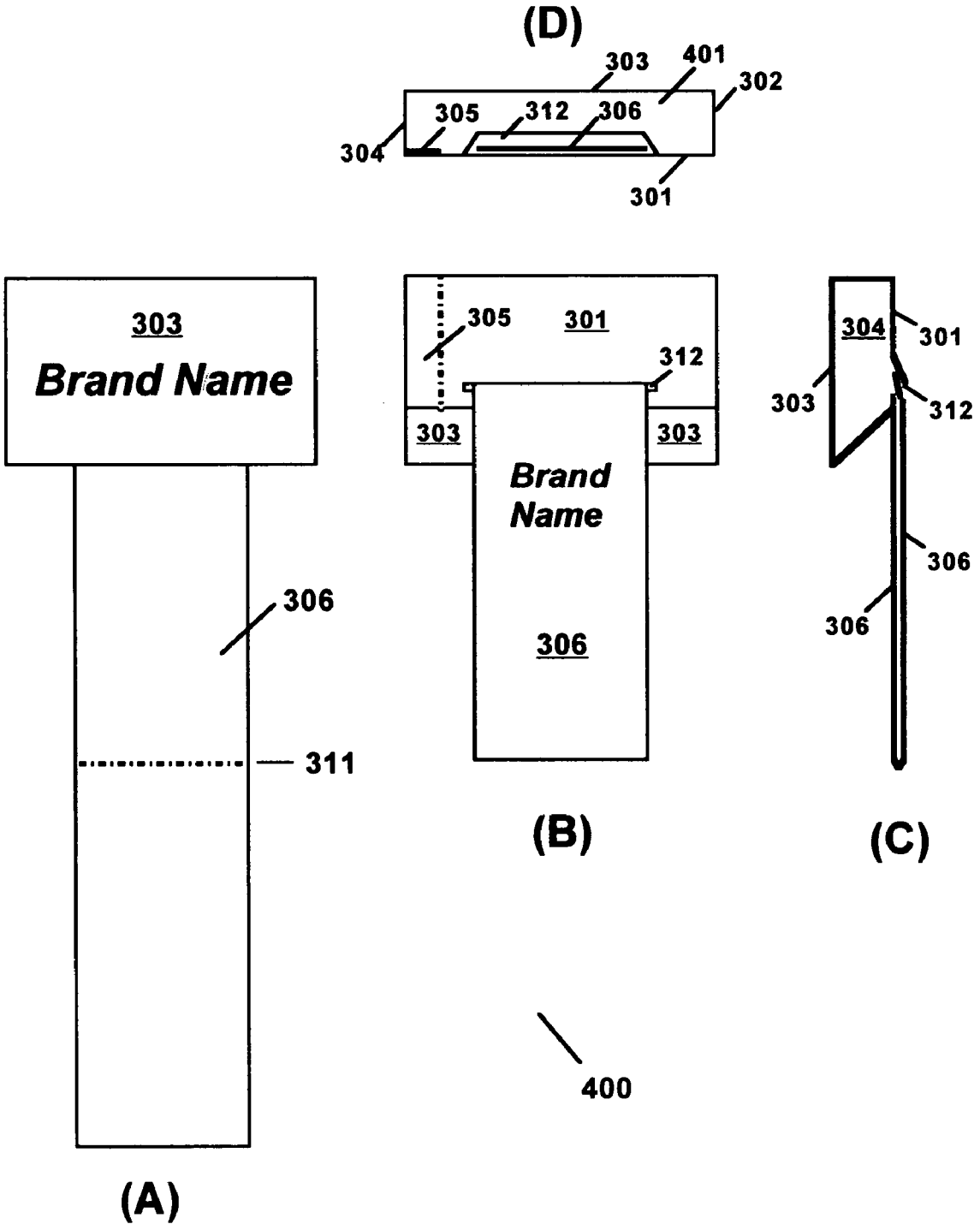
FIG. 4 depicts front (A), back (B), side (C) and top (D) views of a fastener part of a device according to the invention, fabricated from the preform of FIG. 3.

FIG. 4 depicts front (A), back (B), side (C) and top (D) views of a fastener part 400 of a device according to the invention, fabricated from preform 300 of FIG. 3. Fastener part 400 comprises: an open-ended enclosure having a quadrangular cross-section whose four sides 301, 302, 303 and 304 form a conduit opening 401 (FIG. 4D); a rectangular tab strip 306, which is an extension of tab side 301 of said open-ended enclosure and has an unattached end, and includes a rectangular tab strip fold line 311 at a predetermined location; and optionally a linear slit 312 in tab side 301, which is substantially perpendicular to the long sides of the rectangular tab strip 306 and is sufficiently wide to accommodate insertion of the unattached end of rectangular tab strip 306. For clarity, rectangular tab strip 306 is depicted in the unfolded state in FIG. 4A but in its folded state (inserted in linear slit 312) in FIGS. 4B, 4C and 4D. Note that joiner tab 305 is preferably joined to the backside (inside) of tab side 301 via an adhesive, but may be joined to the frontside (outside) of tab side 301 or may be joined by any other suitable means. The necktie brand name (or other advertising) may be printed on either the front side of fastener part 400 (outside of side 303) or the backside of fastener part 400 (outside of tab strip 306), or both.

Numerous variations in the geometry of the fastener part 400 are possible within the scope of the invention. For example, side 303 (front side) and tab side 301 (backside) may be of different lengths so that open-ended enclosure opening 401 has a trapezoidal cross-section rather than the rectangular cross-section of FIG. 4D. Also, sides 302 and 304 may be rectangular so that their bottom edges are horizontal (perpendicular to the other sides) rather than sloping (see FIG. 4C).

Figure 1:
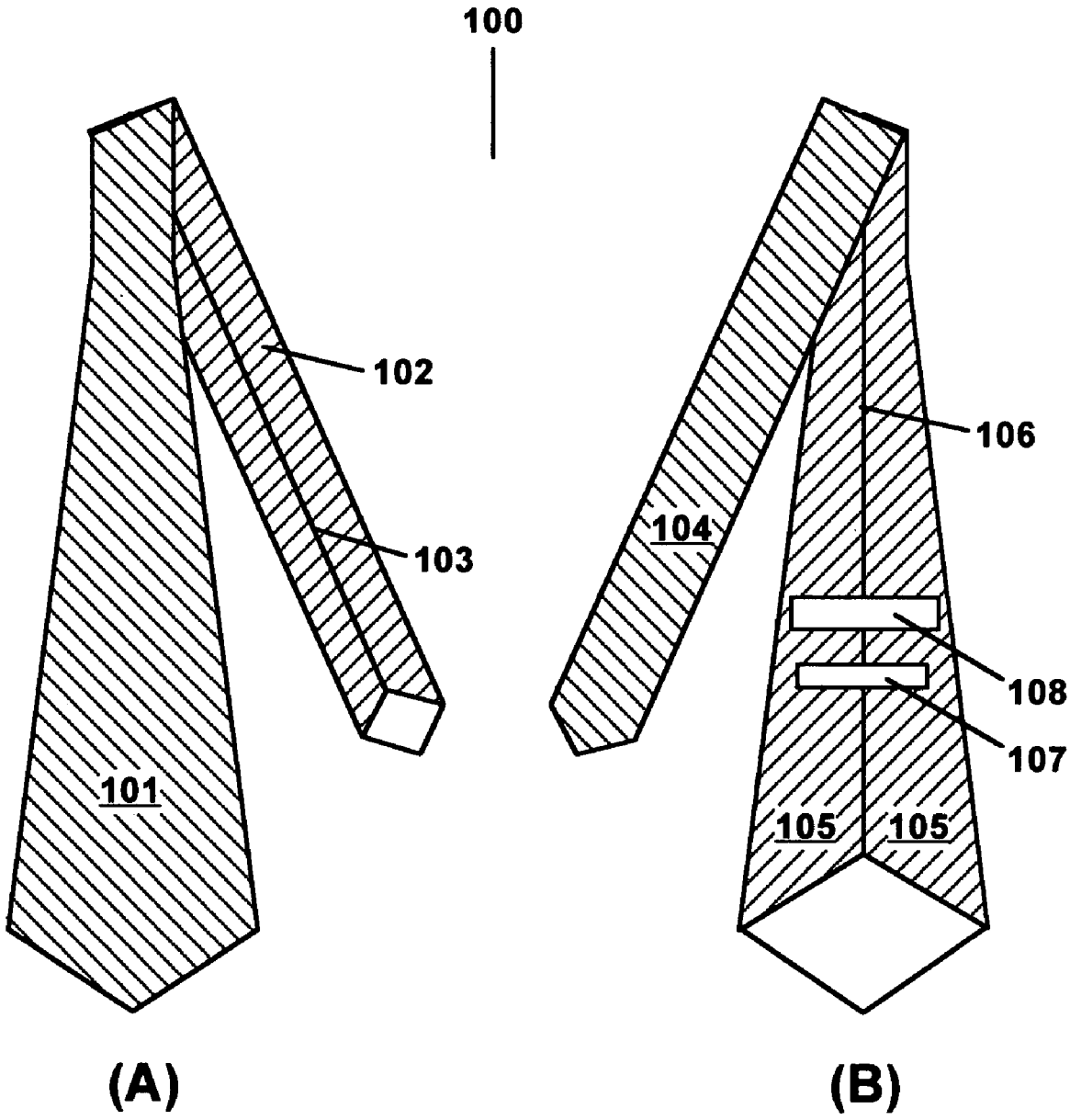
Prior Art FIGURE 1
FIG. 1 depicts two views of a typical modern necktie of the prior art showing: (A) the front side of the wide section and the backside of the narrow section of the necktie; and (B) the front side of the narrow section and the backside of the wide section of the necktie.
Figure 5:
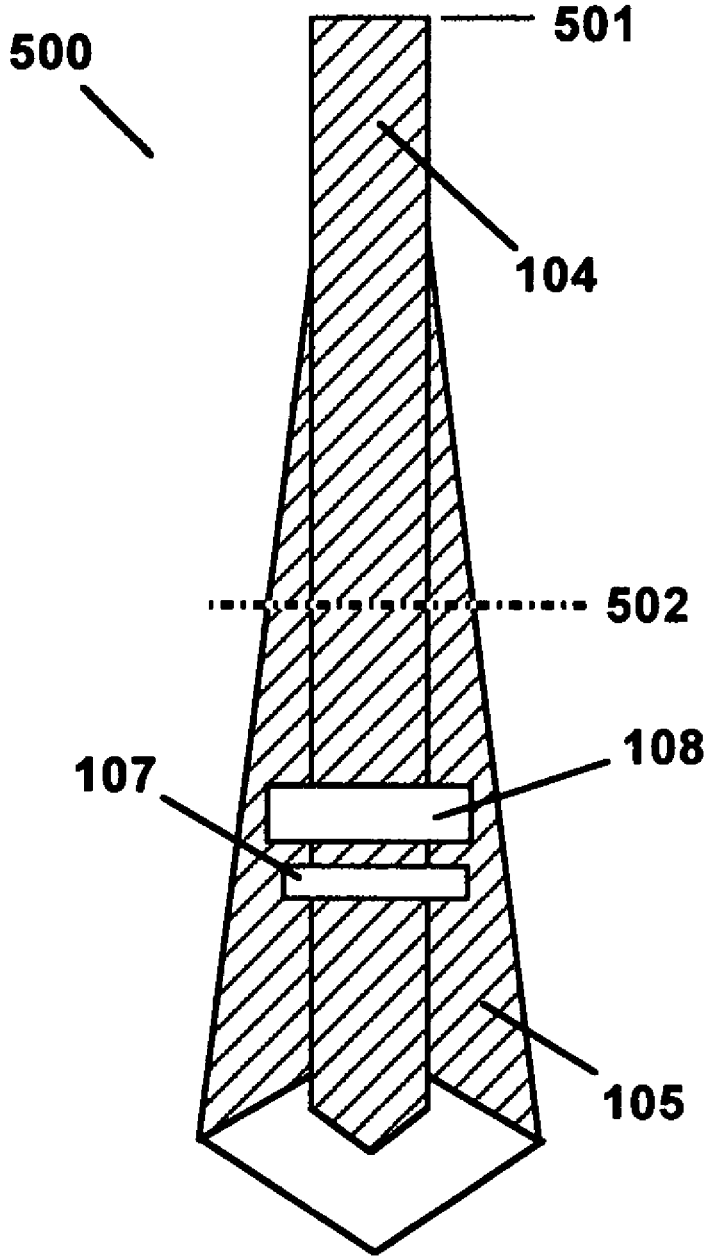
FIG. 5 depicts a preferred necktie configuration for use with the device of the invention.

The method of the invention for packaging a necktie or a plurality of neckties, each having a narrow section and a wide section and at least one of which includes at least one loop 107 and/or 108 in FIG. 1 on the backside of the wide section, comprises the steps of: (1) providing a hanger part comprising a hook attached to a frame that supports one or a plurality of internal bars over at least one of which a necktie is to be installed (as depicted in FIG. 2); (2) folding each necktie to be installed on the hanger part to produce a necktie middle fold 501 of FIG. 5 for which the front side of the necktie faces outward, the narrow section of the necktie preferably passes through at least one loop (107 and/or 108 of FIG. 5) on the backside of the wide section of the necktie, and the end of the narrow section of the necktie is located substantially short of the end of the wide section of the necktie (as depicted in FIG. 5); (3) installing each necktie to be installed on the hanger part such that the necktie middle fold 501 of FIG. 5 and the two ends of each necktie are on the same side of the hanger part and the necktie middle fold 501 of FIG. 5 and the end of the narrow section are located substantially short of the end of the wide section of the necktie (as depicted in FIG. 7B); (4) providing a fastener part fabricated from a sheet of a material, comprising an open-ended enclosure having a quadrangular cross-section whose four sides form a conduit opening 401 of FIG. 4, a rectangular tab strip which is an extension of a tab side of said open-ended enclosure and includes a rectangular tab strip fold line 311 of FIG. 4 at a predetermined location, and, optionally, a linear slit 312 of FIG. 4 in the tab side, which is substantially perpendicular to the long sides of the rectangular tab strip and is sufficiently wide to accommodate insertion of the unattached end of the rectangular tab strip (as depicted in FIG. 4); (5) inserting the necktie middle fold and the ends of the wide and narrow sections of each necktie installed on the hanger part through the conduit opening until the fastener part is located close to the hanger part (as depicted in FIG. 7A); (6) passing the unattached end of the rectangular tab strip of the fastener part through a loop on the backside of the wide section of the necktie contiguous with the rectangular tab strip of the fastener part (as depicted in FIG. 7B); (7) folding the rectangular tab strip of the fastener part at the rectangular tab strip fold line 311 of FIG. 3 (as depicted in FIG. 7B); and (8) attaching the unattached end of the rectangular tab strip to one or both of a bottom area of the tab side or a top area of the rectangular tab strip (as depicted in FIGS. 7B and 8). As those skilled in the art will appreciate, these steps are preferably, but not necessarily, performed in the order given. Preferably, one necktie is installed on each internal bar of the hanger part but fewer neckties may be installed than the number of internal bars.

The unattached end of the rectangular tab strip may be attached in Step (8) to one or both of a bottom area of the tab side or a top area of the rectangular tab strip via any suitable means, comprising, for example, use of an adhesive, including one-sided or two-sided tape, or one or more staples. If the optional linear slit is provided in Step (4), Step (8) may comprise inserting the unattached end of the rectangular tab strip into the linear slit in the tab side of the open-ended enclosure of the fastener part. An adhesive or one or more staples, for example, may also be used to provide a more secure or better aligned attachment when the end of the rectangular tab strip is inserted in a linear slit.

The term "substantially short of" in Step (3), and elsewhere, means that the necktie middle fold and the end of the narrow section of the necktie are sufficiently short of the end of the wide section of the necktie to be hidden behind the wide section of the necktie. The distances separating the necktie middle fold and the end of the narrow section from the end of the wide section are preferably small so that the length of the packaged tie is relatively small but these distances may be any desired distance, from a millimeter or two to ten centimeters or more.

DESCRIPTION OF A PREFERRED EMBODIMENT

A preferred embodiment of the invention is a device for packaging two neckties together in the same package. A preferred method of the invention is described in the preceding paragraph.

FIG. 5 depicts a preferred necktie configuration for use with the device of the invention. Prior to installation on the hanger part, necktie 500 is preferably folded to produce a necktie middle fold 501 for which the front side of the necktie faces outward, the narrow section 104 of necktie 500 passes through at least one of loops 107 and 108 on the backside of wide section 105 of necktie 500, and the end of narrow section 104 is located substantially short of the end of wide section 105, which is according to Step (2) of the method of the invention. Installation of necktie 500 on the hanger part according to Step (3) involves folding necktie 500 along broken line 502 and inserting the loose ends of necktie 500 into the open spaces on either side of a internal bar of the hanger part (see FIG. 2) so that the backside of wide section 105 of necktie 500 rests on the internal bar approximately along broken line 502.

Figure 6:
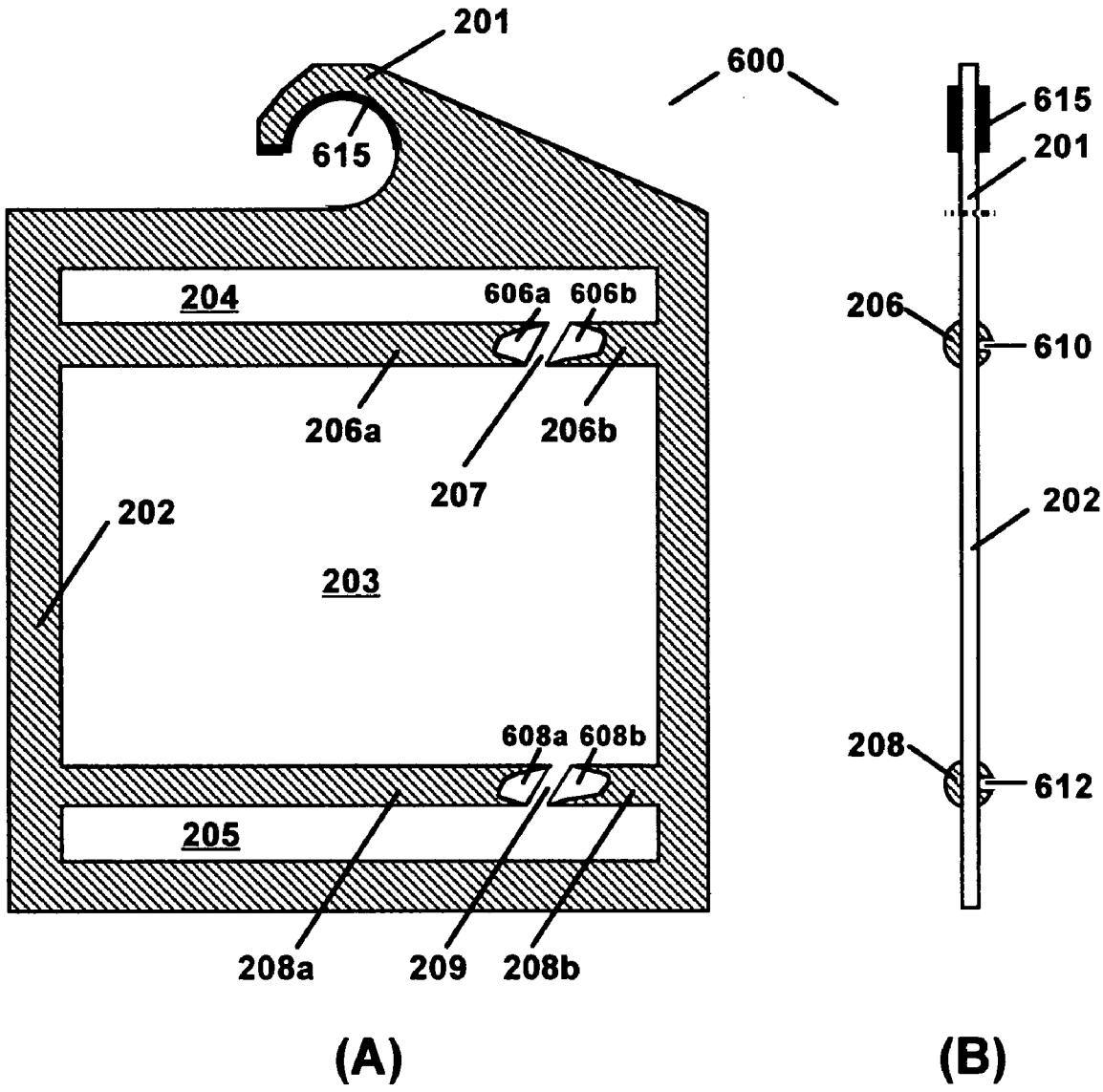
FIG. 6 depicts a front view (A) and a side view (B) of a preferred hanger part of the device of the invention.

FIG. 6 depicts a front view (A) and a side view (B) of a preferred hanger part 600 of the device of the invention, which has two internal bars 206 and 208 with circular transverse cross-sections and discontinuities 207 and 209, respectively, to facilitate installation of two neckties. Preferred hanger part 600 is similar to hanger part 200 of FIG. 2 except for tapered areas 606*a* and 606*b* on internal bar 206 in the vicinity of discontinuity 207 and tapered areas 608*a* and 608*b* on internal bar 208 in the vicinity of discontinuity 209, which are intended to further facilitate installation of the two neckties. Preferred hanger part 600 also has grooves 610 and 612 on the backsides of internal bars 206 and 208, respectively, which imparts more flexibility to the internal bars in the direction perpendicular to frame 202. In addition, hook 201 of preferred hanger part 600 has a widened bottom rim 615. Preferred hanger part 600 preferably comprises a plastic material and is fabricated by injection molding.

With reference to FIG. 6, preferred hanger part 600 has a square frame 202 that is 90×90 mm overall with a square open area of 76×76 mm (7 mm frame width). Internal bars 206 and 208 have an overall circular transverse cross-section of 8 mm diameter and are positioned so that open areas 204 and 205 are 8 mm wide and larger open area 203 is 44 mm wide. The diameter of the circular opening in hook 201 is 18 mm, and the distance from the top of open area 204 to the top of hook 201 is 35 mm. The thickness of frame 202 is 1.5 mm. The thickness of hook 201 is also 1.5 mm, except for widened hook rim 615 which is 3.5 mm thick and 1 mm wide. Grooves 610 and 612 are 2 mm wide and 2 mm deep. Discontinuities 207 and 209 are 2 mm wide, and are slanted at a 45° angle relative to the axes of internal bars 206 and 208. The tips of internal bars 606*b* and 608*b* are 17 mm from the inside edge of frame 202. Tapered areas 606*a*, 606*b*, 608*a* and 608*b* extend 9 mm from the tips of sections 206*a*, 206*b*, 208*a* and 208*b*, respectively, along the axes of internal bars 206 and 208. All dimensions given are approximate and can vary widely within the scope of the invention.

A preferred fastener part is depicted in FIGS. 3 and 4. With reference to FIG. 3, approximate width and height dimensions, respectively, for component areas of the preferred fastener part are: 88.5×37.6 for side 301 (not including rectangular tab strip 306); 82.0×54.6 mm for side 303, 10.3×37.7 mm for joiner tab 305, and 50.7×250 mm for rectangular tab strip 306, which is centered relative to the bottom edge of side 301. Sides 302 and 304 are each 17.2 mm wide and have bottom edges slanted at a 45° angle. Linear slit 312 is 53 mm wide and is centered relative to rectangular tab strip 306 and located 6 mm from its top edge. Fold line 311 is located 111 mm from the bottom edge of rectangular tab strip 306. Note that the width of side 303 is shorter than the width of side 301 so that conduit opening 401 (see FIG. 4D) has a trapezoidal transverse cross-section.

Figure 7:
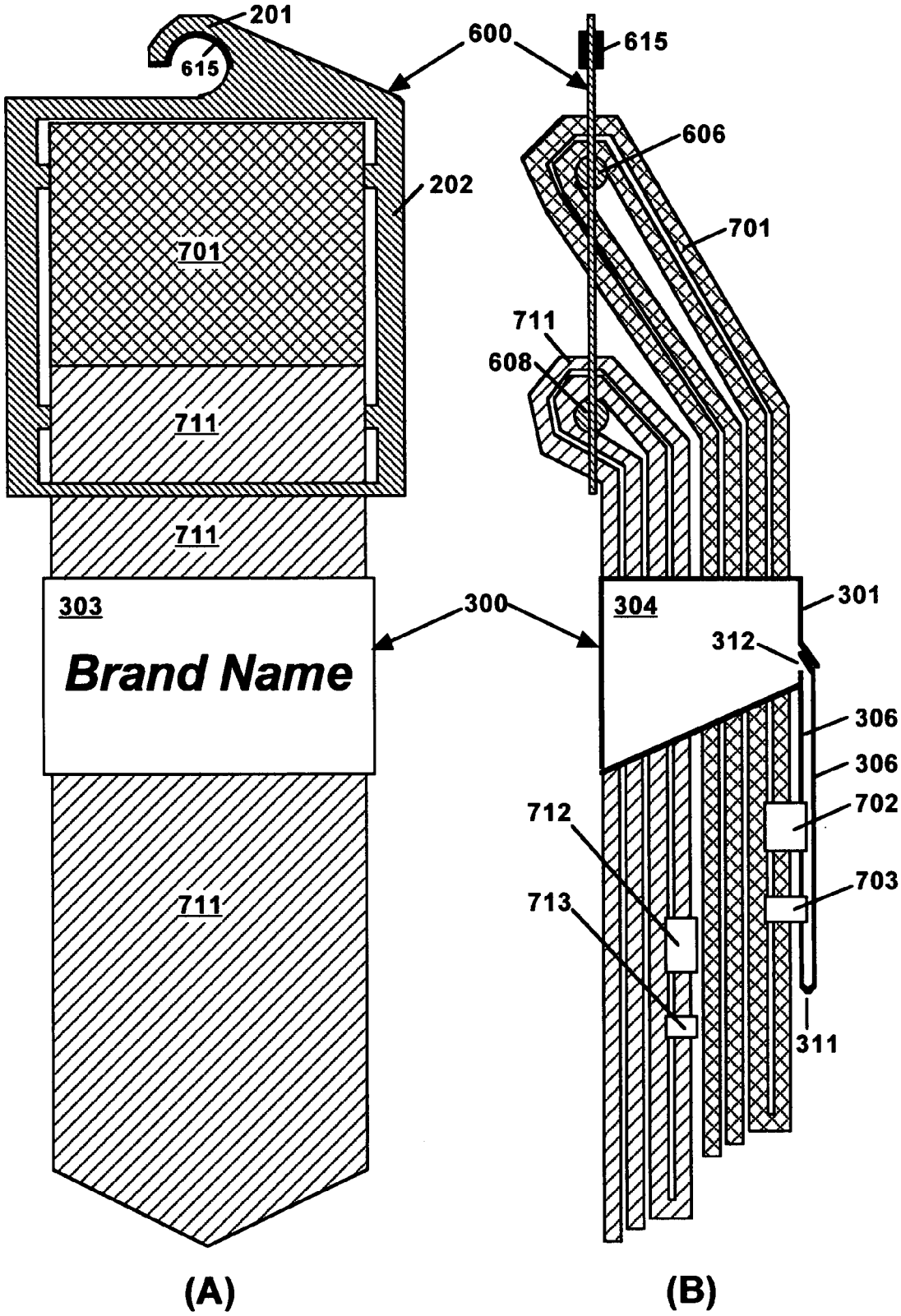
FIG. 7 depicts front (A) and side (B) views of one preferred device according to the invention with two neckties installed therein.
Figure 8:
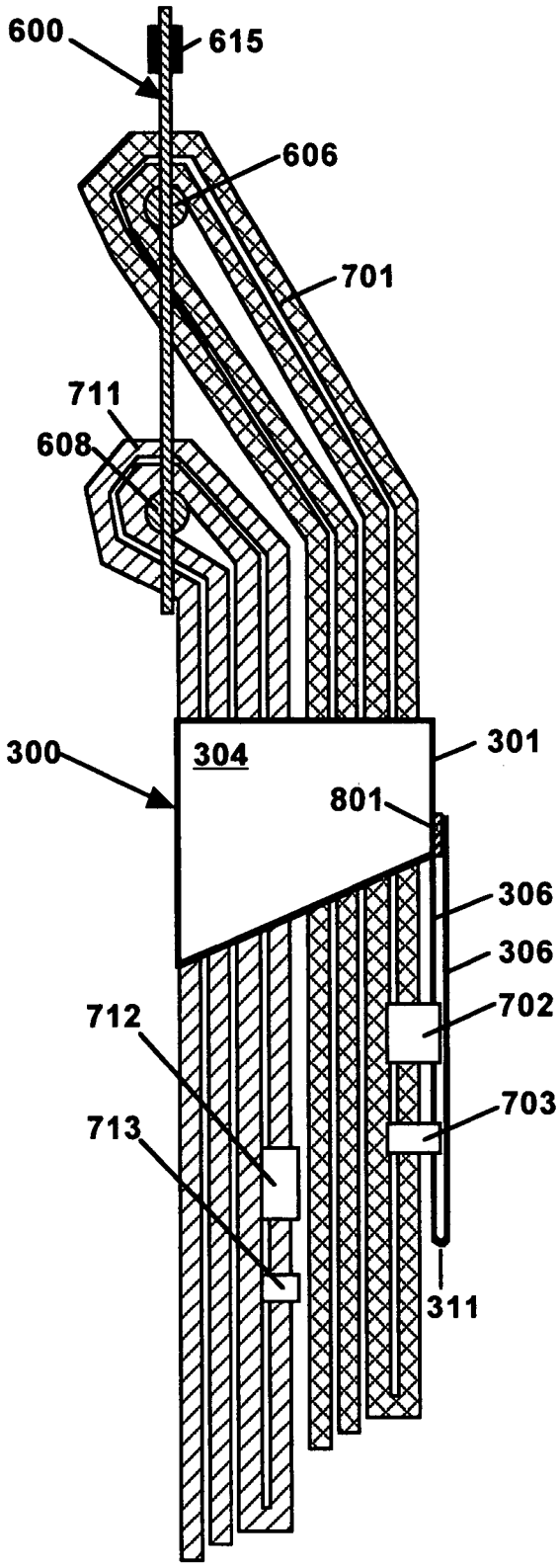
FIG. 8 depicts a side view of a second preferred device according to the invention with two neckties installed therein.

FIG. 7 depicts front (A) and side (B) views of a preferred device according to the invention, comprising preferred hanger part 600 (FIG. 6) and preferred fastener part 400 (FIG. 4), with two neckties 701 and 711 installed therein. For clarity, sides 302 and 304, which would otherwise be visible in FIG. 7A since side 303 is narrower than side 301, have been omitted in FIG. 7A. The brand name and optionally other advertising are preferably printed on the front side 303 (as shown) and the backside 301 (not shown) of fastener part 300.

With reference to FIG. 7, one preferred embodiment of the device of the invention for packaging together neckties 701 and 711, each having a narrow section and wide section and two loops on the backside of the wide section (loops 702 and 703 on necktie 701, and loops 712 and 713 on necktie 711), comprises:

(1) a hanger part 600 comprising a hook 201 attached to a frame 202 that supports an internal bar 606 closer to hook 201 and an internal bar 608 farther from hook 201 over which, respectively, neckties 701 and 711 are installed, each necktie first being folded to produce a necktie middle fold for which the front side of the necktie faces outward, the narrow section passes through both loops on the necktie, and the end of the narrow section is located substantially short of the end of the wide section of the necktie, such that the necktie middle folds and the two ends of both neckties are on the same side of hanger part 600 and the necktie middle fold and the end of the narrow section for each necktie are located substantially short of the end of the wide section of the respective necktie; and (2) a fastener part 300 fabricated from a sheet of a material, comprising an open-ended enclosure having a quadrangular cross-section whose four sides form a conduit opening, a rectangular tab strip 306 which is an extension of tab side 301 of said open-ended enclosure and has an unattached end, and includes a rectangular tab strip fold line 311 at a predetermined location, and a linear slit 312 in tab side 301 that is substantially perpendicular to the long sides of rectangular tab strip 306 and is sufficiently wide to accommodate insertion of rectangular tab strip 306, wherein the necktie middle folds and the ends of the wide and narrow sections of neckties 701 and 711 installed on hanger part 600 are inserted through the conduit opening until fastener part 300 is located close to hanger part 600, and the unattached end of rectangular tab strip 306 is then passed through loops 702 and 703 on the backside of the wide section of necktie 701, rectangular tab strip 306 is folded at rectangular tab strip fold line 311, and the unattached end of rectangular tab strip 306 is inserted into linear slit 312 in tab side 301 of the open-ended enclosure.

FIG. 8 depicts a side view of a second preferred device according to the invention with two neckties installed therein. This device is identical to that of FIG. 7 except that linear slit 312 has been omitted and the unattached end of rectangular tab strip 306 has been attached to a bottom area of tab side 301 using an adhesive 801.

The preferred embodiments of the present invention have been illustrated and described above. Modifications and additional embodiments, however, will undoubtedly be apparent to those skilled in the art. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

I claim:

1. A device for packaging a necktie or a plurality of neckties, each having a narrow section and a wide section and at least one of which includes at least one loop on the backside of the wide section, comprising:

(1) a hanger part comprising a hook attached to a frame that supports one or a plurality of internal bars over at least one of which a necktie is installed, after being folded to produce a necktie middle fold for which the front side of the necktie faces outward, the narrow section of the necktie passes through at least one loop on the backside of the wide section of the necktie, and the end of the narrow section of the necktie is located substantially short of the end of the wide section of the necktie, such that the necktie middle fold and the two ends of the necktie are on the same side of the hanger part and the necktie middle fold and the end of the narrow section are located substantially short of the end of the wide section of the necktie; and (2) a fastener part fabricated from a sheet of a material, comprising an open-ended enclosure having a quadrangular cross-section whose four sides form a conduit opening, and a rectangular tab strip, which is an extension of a tab side of said open-ended enclosure and has an unattached end, and includes a rectangular tab strip fold line at a predetermined location, wherein the necktie middle fold and the ends of the wide and narrow sections of each necktie installed on the hanger part are inserted through the conduit opening until the fastener part is located close to the hanger part, and the unattached end of the rectangular tab strip is then passed through at least one loop on the backside of the wide section of the necktie contiguous with the rectangular tab strip, the rectangular tab strip is folded at the rectangular tab strip fold line, and the unattached end of the rectangular tab strip is attached to one or both of a bottom area of the tab side or a top area of the rectangular tab strip.

2. The device of claim 1, wherein the fastener part further comprises, a linear slit in the tab side, which is substantially perpendicular to the long sides of the rectangular tab strip and is sufficiently wide to accommodate insertion of the unattached end of the rectangular tab strip, wherein the unattached end of the rectangular tab strip is attached to the bottom area of the tab side by inserting the unattached end of the rectangular tab strip into the linear slit in the tab side of the open-ended enclosure.

3. The device of claim 1, wherein at least one internal bar of the hanger part has a transverse cross-section with a dimension greater than the thickness of the frame of the hanger part.

4. The device of claim 3, wherein the transverse cross-section includes a semicircle.

5. The device of claim 1, wherein at least one internal bar of the hanger part has a discontinuity so that a portion of the bar may be temporarily deformed to facilitate installation of a necktie.

6. The device of claim 5, wherein at least one internal bar of the hanger part is tapered in the vicinity of the discontinuity to further facilitate installation of a necktie.

7. The device of claim 1, wherein the hanger part is monolithic.

8. The device of claim 7, wherein the hanger part comprises a plastic material and is fabricated by injection molding.

9. The device of claim 1, wherein the sheet of material used to fabricate the fastener part is selected from the group consisting of cardboard and plastic.

10. The device of claim 1, wherein creases are provided at predetermined locations on the sheet of material to facilitate folding.

11. The device of claim 1, wherein said fastener part is fabricated by an appropriate combination of operations selected from the group consisting of cutting, creasing, folding, stamping and joining.

12. The device of claim 11, wherein the operations of cutting and creasing used to fabricate the enclosure part are performed by a stamping operation.

13. The device of claim 11, wherein the operation of joining is performed using an adhesive.

14. A device for packaging two neckties together, a first and a second, having, respectively, first and second narrow sections and first and second wide sections and including at least a first loop on the backside of the wide section of the first necktie and preferably a second loop on the backside of the wide section of the secondnecktie, comprising:

(1) a hanger part comprising a hook attached to a frame that supports a first internal bar closer to the hook and a second internal bar farther from the hook over which, respectively, the first and the second neckties are installed, after being folded to produce, respectively, first and second necktie middle folds for which the front sides of the two neckties face outward, the first and second narrow sections preferably pass through the first and second loops, respectively, and the ends of the first and second narrow sections are located substantially short of the ends of the first and second wide sections, respectively, such that the necktie middle folds and the two ends of the first and second neckties are on the same side of the hanger part and the first and second necktie middle folds and the ends of the first and second narrow sections are located substantially short of the ends of the first and second wide sections, respectively; and (2) a fastener part fabricated from a sheet of a material, comprising an open-ended enclosure having a quadrangular cross-section whose four sides form a conduit opening, and a rectangular tab strip which is an extension of a tab side of said open-ended enclosure and has an unattached end, and includes a rectangular tab strip fold line at a predetermined location, wherein the necktie middle folds and the ends of the wide and narrow sections of the first and second neckties installed on the hanger part are inserted through the conduit opening until the fastener part is located close to the hanger part, and the unattached end of the rectangular tab strip is passed through the first loop on the backside of the wide section of the first necktie, the rectangular tab strip is folded at the rectangular tab strip fold line, and the unattached end of the rectangular tab strip is attached to one or both of a bottom area of the tab side or a top area of the rectangular tab strip.

15. The device of claim 14, wherein the fastener part further comprises a linear slit in the tab side, which is substantially perpendicular to the long sides of the rectangular tab strip and is sufficiently wide to accommodate insertion of the unattached end of the rectangular tab strip, wherein the unattached end of the rectangular tab strip is attached to the bottom area of the tab side by inserting the unattached end of the rectangular tab strip into the linear slit in the tab side of the open-ended enclosure.

16. A method for packaging a necktie or a plurality of neckties, each having a narrow section and a wide section and at least one of which includes at least one loop on the backside of the wide section, comprising the steps of:

(1) providing a hanger part comprising a hook attached to a frame that supports one or a plurality of internal bars over at least one of which a necktie is to be installed;

(2) folding each necktie to be installed on the hanger part to produce a necktie middle fold for which the front side of the necktie faces outward, the narrow section of the necktie passes through at least one loop on the backside of the wide section of the necktie, and the end of the narrow section of the necktie is located substantially short of the end of the wide section of the necktie;

(3) installing each necktie to be installed on the hanger part such that the middle fold and the two ends of each necktie are on the same side of the hanger part and the necktie middle fold and the end of the narrow section are located substantially short of the end of the wide section of the necktie;

(4) providing a fastener part fabricated from a sheet of a material, comprising an open-ended enclosure having a quadrangular cross-section whose four sides form a conduit opening, and a rectangular tab strip which is an extension of a tab side of said open-ended enclosure and has an unattached end, and includes a rectangular tab strip fold line at a predetermined location;

(5) inserting the necktie middle fold and the ends of the wide and narrow sections of each necktie installed on the hanger part through the conduit opening until the fastener part is located close to the hanger part;

(6) passing the unattached end of the rectangular tab strip of the fastener part through at least one loop on the backside of the wide section of the necktie contiguous with the rectangular tab strip of the fastener part;

(7) folding the rectangular tab strip of the fastener part at the rectangular tab strip fold line; and (8) attaching the unattached end of the rectangular tab strip to one or both of a bottom area of the tab side or a top area of the rectangular tab strip.

17. The method of claim 16, wherein the fastener part provided in Step (4) further comprises a linear slit in the tab side, which is substantially perpendicular to the long sides of the rectangular tab strip and is sufficiently wide to accommodate insertion of the unattached end of the rectangular tab strip, wherein the unattached end of the rectangular tab strip is attached to the bottom area of the tab side by inserting the unattached end of the rectangular tab strip into the linear slit in the tab side of the open-ended enclosure.

* * * * *